United States Patent [19]

Tanaka et al.

[11] Patent Number: 4,825,674

[45] Date of Patent: May 2, 1989

[54] METALLIC TUBULAR STRUCTURE HAVING IMPROVED COLLAPSE STRENGTH AND METHOD OF PRODUCING THE SAME

[75] Inventors: Kenichi Tanaka; Katsuyuki Tokimasa, both of Amagasaki, Japan

[73] Assignee: Sumitomo Metal Industries, Ltd., Tokyo, Japan

[21] Appl. No.: 145,711

[22] Filed: Jan. 15, 1988

Related U.S. Application Data

[63] Continuation of Ser. No. 900,728, Aug. 27, 1986, abandoned, Continuation of Ser. No. 815,311, Jan. 2, 1986, abandoned, Continuation of Ser. No. 742,648, Jun. 10, 1985, abandoned, Continuation of Ser. No. 438,539, Nov. 1, 1982, abandoned.

[30] Foreign Application Priority Data

Nov. 4, 1981 [JP] Japan ..... 177601
Apr. 30, 1982 [JP] Japan ..... 73953

[51] Int. Cl.[4] ..... B21C 37/30
[52] U.S. Cl. ..... 72/98; 72/367
[58] Field of Search ..... 72/98, 99, 367

[56] References Cited

U.S. PATENT DOCUMENTS

| | | | |
|---|---|---|---|
| 2,178,141 | 10/1939 | Frame | 72/367 |
| 3,054,438 | 9/1962 | Wegner et al. | 72/98 |
| 3,222,906 | 12/1965 | Aurin, III | 72/98 |
| 3,464,253 | 9/1969 | Beyer et al. | 72/367 |
| 4,421,575 | 12/1983 | Murata et al. | 148/153 |

FOREIGN PATENT DOCUMENTS 2473555 1/1981 France .

*Primary Examiner*—Lowell A. Larson
*Attorney, Agent, or Firm*—Burns, Doane, Swecker & Mathis

[57] ABSTRACT

Disclosed is a metallic tubular structure having an improved collapse strength characterized in that the tubular structure has a circumferential residual tensile stress left in the inner peripheral surface thereof, said residual stress ranging between 0 and 15 % of the yield stress of the tubular structure. The material of the structure may be any one selected from a group consisting of plain steel, alloy steel, stainless steel and Fe—Ni—Cr alloy. The tubular structure of the invention can suitably be used as pipes under severe condition such as in deep oil wells.

11 Claims, 10 Drawing Sheets

METALLIC TUBULAR STRUCTURE HAVING IMPROVED COLLAPSE STRENGTH AND METHOD OF PRODUCING THE SAME

This application is a continuation, of application Ser. No. 900,728, filed Aug. 27, 1986, which is a continuation of application Ser. No. 815,311, filed Jan. 2, 1986, which is a continuation of application Ser. No. 742,648, filed June 10, 1985, which in turn is a continuation of application Ser. No. 438,539, filed Nov. 1, 1982, all now abandoned.

BACKGROUND OF THE INVENTION

The present invention relates to a metallic tubular structure having an improved collapse strength and also to a method of producing the same.

The term "collapse strength" in this specification is used to mean a strength of a tubular structure against collapse by an external pressure applied to the tubular structure. The tubular structure to which the invention pertains includes various members generally having a tubular form, particularly pipes, tubes and casing used in oil wells.

The current shortage of petroleum and natural gas resources has increased a tendency for deepening of oil and gas wells, which in turn tends to involve inclusion of hydrogen sulfide in the produced petroleum and gases. The tubes used in such wells, therefore, are required to have superior collapse strength, as well as high corrosion resistance.

However, corrosion resistance and collapse strength are generally considered as being incompatible with each other. More specifically, although the collapse strength can be increased through an increase of the yield strength by improvement of the material, i.e. by adjustment of components and heat-treatment, the increase in the yield strength is nothing but an increase in the tensile strength which is inevitably accompanied by a degragation in the resistance to corrosion. Therefore, there is a practical limit to the increase of the collapse strength through adjustment of the material and, hence, the improvement in the material alone cannot constitute an effective measure for improving the collapse strength of the pipes used in oil or gas wells.

In order to obtain pipes for use in oil wells usable under such severe condition, it is necessary to improve the collapse strength independently of the corrosion resistance. To this end, various methods have been proposed as listed below.

(1) To effect a contraction processing on pipe (2) To omit straightening steps (3) To conduct the straightening step in a warm state (4) To effect water cooling following quench-tempering.

The above-mentioned methods, however, have their own drawbacks or shortcomings.

For instance, the above-mentioned method (1) suffers from the following problem. Contraction processing is effected to increase only the circumferential yield strength, which directly contributes to the increase in the collapse strength, while maintaining the tensile strength unchanged. The problem arises from the use of a specific contracting means. Namely, the contracting means includes a plurality of circumferential segments. It is quite difficult to obtain uniform contact of the circumferential segments over the entire periphery of the steel pipe and, therefore, the rate of increase in the yield strength fluctuates over the circumference of the steel pipe. With this method, therefore, it is not possible to attain a stable and effective improvement in the collapse strength.

The method (2) mentioned above is based upon a finding that a reduction in the collapse strength is often caused by residual compression stress in the inner peripheral surface of the steel pipe caused by a straightening which is conducted as the final step of the pipe producing process. If this straightening step is to be omitted, it is necessary to carry out the preceding steps at an impractically high precision. In fact, it is quite difficult to produce steel pipes meeting the customer's precision requirements without the step of straightening, particularly when the pipe diameter is small.

The method (3) is intended for eliminating the generation of the aforementioned residual stress by conducting the straightening at an elevated temperature. This method does not involve any substantial problems but, as in the case of the method (2) mentioned before, the elimination of residual stress is not a positive measure and cannot provide sufficient effect by itself.

The method (4) has been proposed in Japanese Patent Laid-open No. 33424/1981. This method is based upon a technical idea that the collapse strength can be increased by imparting residual tensile stress of a level higher than 20 $Kg/mm^2$ but lower than the yield stress to the inner peripheral surface, and teaches that such residual tensile stress is obtainable by a water cooling subsequent to the tempering. This prior art, however, does not make clear the relationship between the condition of water cooling and the level of the residual stress. The method (4), therefore, is not considered as being an established method which can stably improve the collapse strength of the steel pipe. It is to be pointed out also that the idea concerning the relationship between the collapse strength and the residual tensile stress is incorrect, as will be understood from the following brief explanation. To sum up, the above-mentioned technical idea necessitates an assumption or hypothesis that the collapse of a pipe under application of external force starts at the inner side of the pipe. Such an assumption does not always match the actual case. Namely, when a residual stress is previously developed in the circumferential direction of the steel pipe, the collapse does not always begin with the inner surface of the pipe but in some cases it begins with the external surface of the pipe when the residual circumferential stress in the inner peripheral surface of the pipe exceeds a certain level. The above-mentioned assumption can by no means applies to such a case. It would be not too much to say that the above-mentioned technical idea is an empty theory. Such an empty theory can by no means provide a stable effect.

Thus, all of the methods proposed hitherto for improving the collapse strength regardless of the corrosion resistance are imperfect and unsatisfactory.

SUMMARY OF THE INVENTION

Accordingly, an object of the invention is to provide a metallic tubular structure having an improved collapse strength, as well as a method of producing such a tubular structure, in view of the background of the invention explained hereinbefore with reference to prior arts.

Another object of the invention is to provide a metallic tubular structure in which the collapse strength is improved without being accompanied by deterioration in corrosion resistance, as well as a method of producing the same.

Still another object of the invention is to provide a metallic tubular structure, particularly a steel pipe, suited to use under severe condition including the presence of hydrogen sulfide, as in deep wells, as well as a method of producing the same.

To these ends, according to the invention, there is provided a metallic tubular structure having an improved collapse strength characterized in that the tubular structure has a circumferential residual tensile stress in the inner peripheral surface thereof, the residual stress ranging between 0 and 15% of the yield stress of the tubular structure.

Preferably, the residual tensile stress ranges between 4% and 10% of the yield stress.

According to one aspect of the invention, there is provided a metallic tubular structure wherein the tubular structure is made of a material selected from a group consisting of plain steel, alloy steel, stainless steel and Fe—Ni—Cr alloy.

According to still another aspect of the invention, the circumferential residual tensile stress is imparted to the inner peripheral stress of the tubular structure by uniformly cooling the heated tubular structure from the outer side of the structure.

According to a further aspect of the invention, the cooling is commenced at a temperature not lower than $(\sigma_y/E+172)$°C.

According to a still further aspect of the invention, the cooling is conducted by applying cooling water uniformly to the outer peripheral surface of the tubular structure at a rate W satisfying the following condition while axially feeding the tubular structure.

$$\frac{1}{t^2}\left(\frac{0.012}{B/0.04-1}\right)^2 \cdot D \cdot V \leqq W \leqq \frac{1}{t^2}\left(\frac{0.012}{B/0.10-1}\right)^2 \cdot D \cdot V$$

where,

W: rate of supply of cooling water (ton/min)

t: wall thickness of tubular structure (mm)

D: outside diameter of tubular structure (mm)

V: velocity of feed of tubular structure (mm/min)

B: $188.8\gamma(T-172-\sigma y/E.\sigma)$ $\gamma$: thermal expansion coefficient of material T: temperature at which cooling is commenced (°C.)

$\sigma y$: yield strength of material

E: Young's modulus (Kgf/mm$^2$)

According to a still further aspect of the invention, the residual tensile stress is imparted to the inner peripheral surface of the tubular body or structure by causing a uniform plastic deformation of the inner peripheral surface in the circumferential direction.

According to a still further aspect of the invention, the circumferential residual tensile stress is generated uniformly by applying at least a pair of diametrically opposed distributed loads to the outer peripheral surface of the tubular structure, and repeating the application of the distributed loads while changing the points of application of the loads on the outer peripheral surface of the tubular structure.

According to a still further aspect of the invention, the circumferential residual tensile stress is imparted by feeding the tubular structure through a plurality of groups of rings, each group comprising at least three rings, each of which have an inside diameter slightly greater than the outside diameter of the tubular structure, the rings being arranged so that the tubular structure can run through the internal bores of the rings, each of the groups further comprising driving means adapted to drive the adjacent rings in the directions opposed to each other in the diametrical direction of the tubular structure thereby to press the outer peripheral surface of the tubular structure, the tubular structure being made to pass through the groups of rings in such a manner that the points of application of pressure by the rings caused by the driving means are distributed over the peripheral surface of the tubular structure.

According to a still further aspect of the invention, the distributed load $P_1$ given by each ring group to the tubular structure is determined to satisfy the following condition.

$$P_1 \geqq \frac{2Et^3}{3D} \cdot \frac{\left(\frac{1}{D}-\frac{1}{D_R}\right)}{\left(1-\frac{2}{\pi}\right)}$$

where,

E: Young's modulus

D: outside diameter of tubular structure t: wall thickness of tubular structure $D_R$: inside diameter of ring According to a still further aspect of the invention, the circumferential residual tensile stress is imparted to the inner peripheral surface of the tubular structure by applying compression loads on the tubular structure at two pairs of loading points, each pair including two points which are located within an angular range of 40° to 90° from the center of a cross-section of the tubular structure and disposed on the same cross-section of the tubular structure, the two pairs of loading points being arranged in symmetry with respect to the center of cross-section of the tubular structure, the application of compression loads being repeatedly conducted on different circumferential and axial portions of the tubular structure.

According to a still further aspect of the invention, the compression loads are applied by a pair of U-shaped blocks, each of which make contact with the tubular structure at two points which are located within the angular range of the 40° to 90° from the center of cross-section of the tubular structure. The U-shaped blocks may have a length greater than the axial length of the tubular structure, and the compression loads are applied repeatedly while rotating the tubular structure intermittently around its axis over a predetermined angle.

Alternatively, the U-shaped blocks have a length smaller than the axial length of the tubular structure and are arranged in a plurality of pairs in such a manner that the directions of compression loads imparted by these pairs are staggered by a predetermined angle around the axis of the tubular structure, and the compression loads are continuously applied while feeding the tubular structure through the pairs of blocks.

BRIEF DESCRIPTION OF THE DRAWINGS

Other objects, features and advantages of the invention will become clear from the following description of the preferred embodiments taken in conjunction with the accompanying drawings in which:

FIGS. 18, 19 and 20 show the result of Embodiment 2, wherein FIG. 18 shows the relationship between the temperature at which the cooling is started and the circumferential residual stress $\sigma_R$ in the inner peripheral surface of the steel pipe, FIG. 19 shows the relationship between the flow rate of cooling water and the level of the residual stress $\sigma_R$ and FIG. 20 shows the collapse strength of a steel pipe treated in accordance with the invention, in comparison with that of a steel pipe which has not been subjected to a cooling treatment following quenching and tempering;

FIGS. 21, 22 and 23 show the result of Embodiment 3 of the invention, wherein FIG. 21 is a graph showing the level of the residual stress $\sigma_R$ in the inner peripheral surface of the pipe treated in accordance with the method of the invention with various values of ring inside diameter $D_R$ and crushing amount, FIG. 22 is a graph showing the relationship between the crushing amount and the load $P_1$ applied to the pipe, and FIG. 23 is a graph showing the relationship between the crushing amount and the level of the residual stress $\sigma_R$ by the conventional method.

DESCRIPTION OF THE PREFERRED EMBODIMENT

Figure 1:
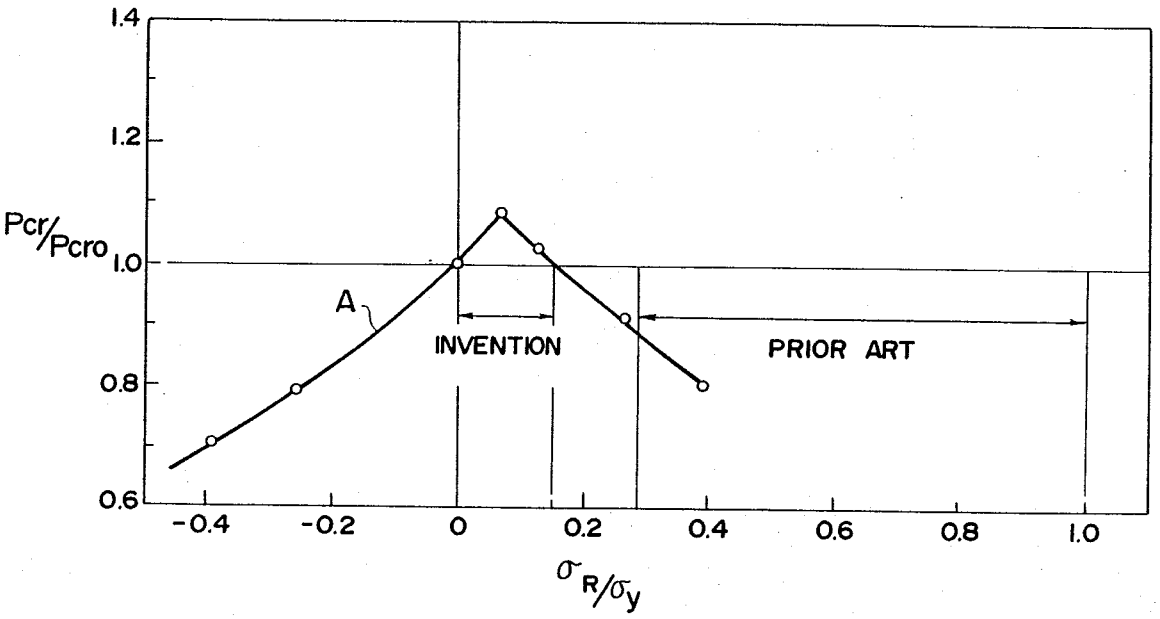
FIG. 1 is a graph showing the relationship between the circumferential residual stress in the inner peripheral surface of the metallic tubular structure and the collapse strength.

With full recognition of the close relationship between the collapse strength in metallic tubular structure and the circumferential residual stress in the same, the present inventors have clarified a definite relationship between the collapse strength and the residual stress as shown in FIG. 1, through intense study and experiment for a long period of time.

In FIG. 1, the abscissa represents the ratio $\sigma_R/\sigma_Y$ between the circumferential residual stress $\sigma_R$ in the inner peripheral surface of the pipe and the yield stress $\sigma_Y$ of the pipe material, while the axis of ordinate represents the ratio Pcr/Pcro between the pressure Pcr for collapsing the pipe and the pressure Pcro for collapsing a pipe having no residual stress at the inner surface. It will be seen that a superior collapse strength is obtainable when the circumferential residual stress $\sigma_R$ in the inner peripheral surface is a tensile stress, i.e. when the condition $\sigma_R>0$ is met, while the percentage thereof to the yield stress $\sigma_Y$ ranges between 0 and 15%, preferably between 4% and 10%. The greatest reistance to collapse may be obtained when the circumferential residual stress $\sigma_R$ equals to about 0.07 $\sigma_Y$. In FIG. 1, both the ordinate and abscissa are plotted as numerical values having no dimensions. These relations are not determined by the yield stress of the tubular structure nor by the material, but are determined purely in term of dynamics and, hence, this relation is applicable generally to ordinary metallic materials. The range of residual stress as observed in the prior art disclosed by the aforementioned Japanese Patent Laid-open No. 33424/1981 is shown in FIG. 1 as prior art by way of reference. It will be seen that the collapse strength is not increased but is rather decreased.

Figure 2A:
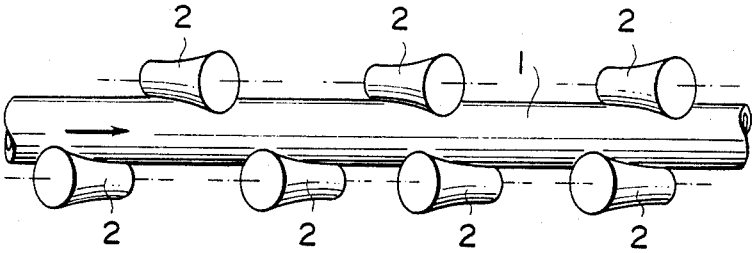
FIGS. 2A and 2B show schematically a straightening in accordance with prior art and a stress distribution in the tubular structure caused by the straightening.

In the production of conventional steel pipes for oil wells, as shown in FIG. 2A, the so-called straightening step is conducted for levelling and straightening the steel pipe 1 by passing the same along a path formed between a plurality of rolls arranged at the upper and lower sides in a staggered manner, each roll being contracted at its central portion. The stress distribution in the cross-section of the steel pipe resembles that formed when the steel pipe 1 receives a load concentrated at one point thereon, as shown in FIG. 2B.

Figure 2B:
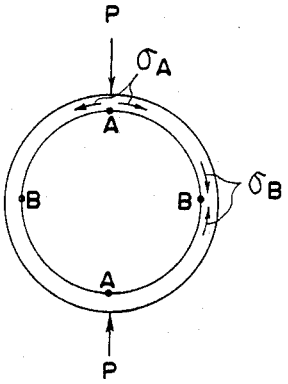

When the steel pipe has a considerably thin wall, the following bending moments appear at the point A in FIG. 2B and a point B which is 90° apart from the point A. (1) bending moment at point A ($M_A$)

$$M_A = -\frac{PD}{2\pi}$$

where, D represents the outside diameter of the pipe. (2) bending moment at point B ($M_B$)

$$M_B = \frac{PD}{4}\left(1 - \frac{2}{\pi}\right)$$

Therefore, the following relationship exists between the stress $\sigma_A$ and the stress $\sigma_B$ appearing at the points A and B.

$$\frac{\sigma_A}{\sigma_B} = \frac{2}{\pi} \cdot \frac{1}{\left(1 - \frac{2}{\pi}\right)} \approx -1.75$$

Thus, the absolute value of the tensile stress appearing at the point A is always greater than that of the compressive stress appearing at the point B. In the conventional straightening step shown in FIG. 2A, therefore, a compression residual stress is inevitably produced in the inner surface of the pipe to cause a decrease in the collapse strength.

The straightening step, however, is indispensible for levelling or correcting the shape of metallic pipe produced by ordinary pipe making processes.

The inventors, therefore, made an intense study for imparting residual tensile stress to provide values of the ratio $\sigma_R/\sigma_Y$ ranging between 0 and 15% in two ways, namely by a thermal or heat treatment and by mechanical treatment.

How to impart the residual stress by heat treatment

The inventors have made study and experiments for finding out a suitable method for imparting circumferential tensile residual stress in the inner peripheral surface of a steel pipe by a heat treatment.

Figure 3:
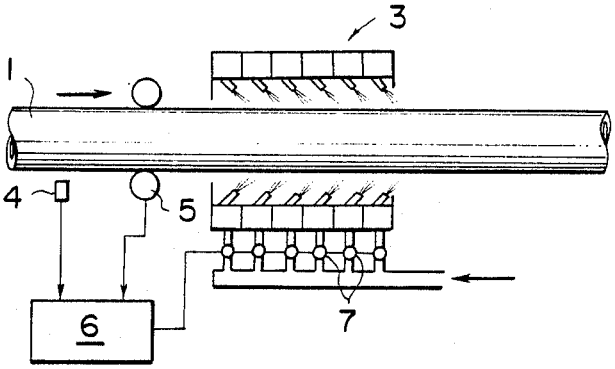
FIG. 3 is a schematic illustration of a cooling system employed in one embodiment of the invention.

FIG. 3 shows a cooling system employed in the experiment. The cooling system shown in FIG. 3 includes water-cooling nozzles 3 surrounding the steel pipe 1 which is conveyed in the axial direction, a thermometer 4 for detecting the temperature of the steel pipe 1, a speed meter 5 for detecting the speed of convey of the steel pipe, a processor 6 for computing the flow rate of cooling water W in accordance with a predetermined formula from previously given factors such as the size of the steel pipe and physical constants of the steel pipe (such as $\sigma_Y$ and E), and a solenoid valve 7, the opening degree of which is controlled by the processor 6. The following facts were proved as the result of the experiments and discussion.

The level of the circumferential residual stress generated in the steel pipe by water cooling is closely related to the level of strength of the steel pipe, i.e. the yield stress $\sigma_Y$ (Kgf/mm$^2$), not to mention the size of cross-section, i.e. outside diameter D(mm) and wall thickness t(mm), and rate W(Ton/min) of supply of the cooling water.

It is assumed here that the heated steel pipe 1 is moved in the axial direction at a velocity V(mm/min) and cooling water is supplied uniformly to the entire periphery of the moving steel pipe 1 from an annular nozzle 3 surrounding the line of movement of the steel pipe 1 thereby to cool the steel pipe 1 uniformly. In this case, the level $\sigma_R$ of the circumferential residual stress in the inner peripheral surface of the steel pipe after the cooling treatment can be expressed by the following formula (1) in relation to the conditions mentioned above.

$$\sigma_R = \frac{188.8\gamma \cdot \sigma_Y\{(T - 172) - \sigma_Y/E \cdot \gamma\}}{1 + 0.0120/\{t\sqrt{W/D \cdot V}} \quad (1)$$

where,

T: temperature at which the cooling is commenced (°C.)

E: Young's modulus of steel pipe (Kgf/mm$^2$)

$\gamma$: thermal expansion coefficient of pipe material (1/°C.)

The relationship as expressed by the formula (1) is obtainable when the temperature (T) at which the cooling of steel pipe is started is higher than $(\sigma_y/(E.\gamma)+172)$° C. If the temperature T is below the temperature specified above, no residual stress is developed in the tensile direction in the inner surface even by the cooling treatment.

On the other hand, the collapse strength of the steel pipe is increased when the circumferential residual stress $\sigma_R$ in the inner surface of the pipe meets the condition of $0<\sigma_R<0.15\ \sigma_Y$, and is maximized when the stress level $\sigma_R$ equals to about 0.07 $\sigma_Y$. For attaining a stable improvement of the collapse strength, it is preferred to control the rate of supply of the cooling water to meet the condition of $0.04\ \sigma_Y<\sigma_R<0.1\ \sigma_Y$. By developing the residual stress falling within this range, it is possible to attain more than about 4% increase in the collapse strength. The rate of supply of cooling water for developing the residual tensile stress falling within the range of $0.04\ \sigma_Y<\sigma_R<0.10\ \sigma_Y$ is calculated in accordance with the following formula (2).

$$\frac{1}{t^2}\left(\frac{0.012}{B/0.04-1}\right)^2 \cdot D \cdot V \leqq W \leqq \frac{1}{t^2}\left(\frac{0.012}{B/0.10-1}\right)^2 \cdot D \cdot V \quad (2)$$

where, B is equal to $188.8\ \gamma(T-172-\sigma y/E.\gamma)$

Figure 4:
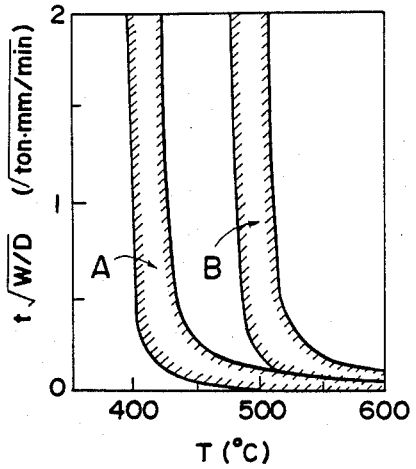
FIG. 4 is an illustration of an example in which the flow rate of cooling water is determined within a preferred range according to one embodiment of the invention.

The relationship between the rate of supply of cooling water and the temperature was calculated for each of two cases: namely a case A in which the pipe speed V, and yield strength $\sigma_Y$ were 550 mm/min and 77 Kgf/mm$^2$, and a cae B in which V and $\sigma_Y$ were 550 mm/min and 56 Kgf/cm$^2$, respectively, in accordance with the formula (2) above. The result of calculation is shown in FIG. 4.

The heating of the metallic tubular structure may be effected by making use of the temperature of the tubular structure as obtained in the preceding step of process. For instance, the cooling may be started at the temperature after the quench-tempering in the process of making oil well pipes or at the temperature obtained after the straightening at elevated temperature.

Figure 5:
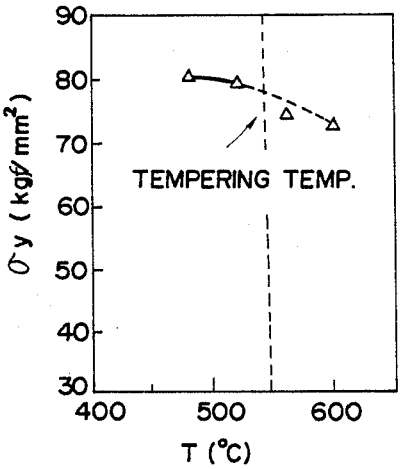
FIG. 5 is a graph showing the relationship between the temperature at which the cooling is started and a change in the yield point of the resulting steel pipe.

FIG. 5 shows the relationship between the temperature T at which the cooling is commenced and the yield strength of the resulting steel pipe. It will be seen that, when the temperature T exceeds the tempering temperature, the yield stress $\sigma_Y$ and, hence, the collapse strength are lowered undesirably.

It is, therefore, preferred that the temperature T at which the cooling is commenced is not lower than the temperature $(\sigma_y/E.\gamma+172)$° C. and not higher than the tempering temperature.

How to impart residual stress by mechanical treatment

As stated before, the stress distribution exerted during the conventional straightening step resembles that produced by load application at two points, i.e. at an upper point and a lower point, so that a compressive residual stress develops in the inner peripheral surface of the tubular structure to seriously lower the collapse strength.

Under this circumstance, the inventors have made a study to find a suitable method for imparting circumferential tensile residual stress to the inner peripheral surface of the tubular structure by applying a load distributed uniformly over the periphery of the tubular structure or by applying load at two upper points and two lower points simultaneously.

(P1) Application of distributed load

Figure 6:
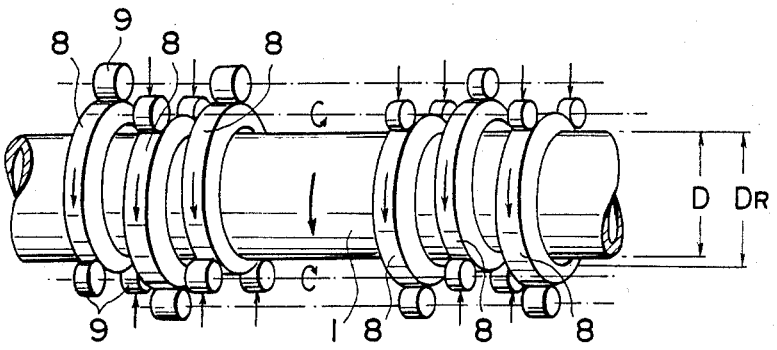
FIG. 6 shows a device in accordance with an embodiment of the invention, for straightening a tubular structure while imparting a residual tensile stress in the inner peripheral surface of the tubular structure.

The inventors considered applying compressive distributed loads in the upper and lower directions to the outer periphery of the tubular structure by employing a device as shown in FIG. 6. More specifically, the device shown in FIG. 6 includes two sets of rings, each consisting of three rings 8 having an inside diameter $D_R$ slightly greater than the outside diameter D of the tubular structure 1, the three rings 8 being arranged in a side-by-side fashion. Each ring 8 is rotatably supported by three supporting rollers 9 which are driven at an equal speed in such a manner that all rings 8 are driven in the same direction. The rollers 9 are displaceable in the vertical direction and are adapted to be moved up and down by means not shown. The adjacent rollers of the same group are adapted to be displaced in opposite vertical directions so that compressive stress in the vertical direction is exerted in the upward and downward directions to the tubular structure 1 placed within the rings, while simultaneously functioning as a straightener to correct the shape of the tubular structure 1.

Figure 7:
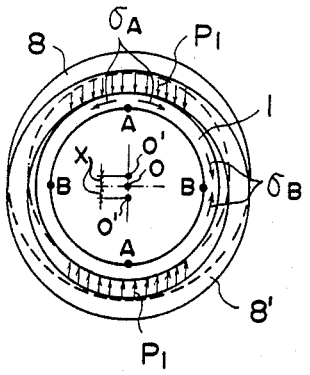
FIG. 7 shows the stress distribution in the cross-section of the tubular structure under treatment by the device shown in FIG. 6.

FIG. 7 shows the stress distribution developed in the cross-section of the tubular structure 1 subjected to the compression load applied by the device shown in FIG. 6. As will be seen from FIG. 7, the tubular structure 1 receives a distribution load $P_1$ by the downwardly displaced rings 8 and the upwardly displaced ring 8'.

The stress $\sigma_A$ appearing at the point A in the inner surface of the tubular structure is expressed as follows within the elasticity limit.

$$\sigma_A = Et\left(\frac{1}{D} - \frac{1}{D_R}\right)$$

where,

E: Young's modulus t: wall thickness of tubular structure $D_R$: inside diameter of ring Thus, the stress appearing at the point A depends solely on the cross-sectional shape of the rings and the tubular structure, and is independent of the level of the distributed load $P_1$.

On the other hand, the stress $\sigma_B$ appearing at the point B which is 90° apart from the point A can be approximated by the following formula.

$$\sigma_B = \frac{-3P/D}{2t^2}\left(1 - \frac{2}{\pi}\right)$$

where, $P_1$: load per unit length

Thus, the stress $\sigma_B$ varies in accordance with the level of the distributed load $P_1$. It is, therefore, possible to obtain a stress $\sigma_B$ of which the absolute value is greater than that of the stress $\sigma_A$, by suitably selecting the inside diameter $D_R$ of the rings and the load $P_1$. The distributed load $P_1$ which satisfies the requirement of $|\sigma_B| \geqq |\sigma_A|$ is given by the following formula (3).

$$P_1 \geqq \frac{2Et^3}{3D} \cdot \frac{\left(\frac{1}{D} - \frac{1}{D_R}\right)}{\left(1 - \frac{2}{\pi}\right)} \quad (3)$$

To sum up, by adopting the mechanical treating method as illustrated in FIG. 6, it is possible to optionally control the level of the circumferential residual stress in the inner peripheral surface of the tubular structure after the straightening step, i.e. to nullify the residual stress or to develop the residual stress in the tensile direction. It is, therefore, possible not only to avoid undesirable decrease in the collapse strength but rather to positively increase the collapse strength.

In carrying out the invention by employing the device as shown in FIG. 6, the supporting positions at which the rings 8 are supported by the supporting rollers 9 are offset in the vertical direction in an alternating manner as illustrated to definitely set the offset X between the center O' of the rings 8 shown in FIG. 7 and the center O of the pipe 1 passing through the rings 8. The offset X will be referred to as "crush amount", hereinafter. The setting of the crush amount X means the setting of the level of the distributed load $P_1$ applied to the tubular structure. The crush amount X is optimumly selected to provide necessary load for the correction taking into account the fact that a greater crush amount produces a greater load. After the setting of the crush amount, all of the rings 8 are driven positively, and the tubular structure 1 to be treated is made to pass through the groups of the rings 8 at a predetermined speed from one side of the ring groups. The feed of the tubular structure may be performed by a known driving means such as a pusher. When passing through the groups of rings, the tubular structure is rotated to receive distributed load over its entire outer peripheral surface by the rings 8 contacting with outer peripheral surface thereof, so that bending and compression are applied to the tubular structure 1 to correct the shape of the latter.

As will be understood from the foregoing description, the level of the residual stress developed in the tubular structure after the straightening step varies depending largely on the inside diameter $D_R$ of the rings and the level of distributed load applied during the treatment, i.e. the crush amount X mentioned before. More specifically, the residual stress tends to change its direction from the compressive one to the tensile one as the inside diameter $D_R$ of the rings is reduced and as the crush amount X is increased. This fact suggests that, by suitably selecting the inside diameter $D_R$ and the crush amount X, it is possible to control the residual stress to make it fall within a range (the range "invention" in FIG. 1) optimum for ensuring sufficient collapse strength while maintaining the necessary straightening or correcting effect.

Figure 8:
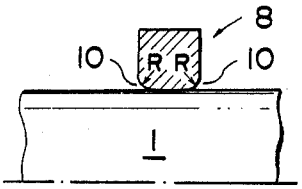
FIGS. 8 and 9 show preferred examples of rings incorporated in the device shown in FIG. 6.

Preferably, the corners 10 of each ring 8 contacting the outer surface of the tubular stracture 1 used in this treatment are rounded as shown in FIG. 8, in order to avoid any damage on the external surface of the tubular structure. To this end, the radius R of curvature of the rounded corner should be at least 5 mm. Namely, according to the theory of resilient contact, an infinite stress is applied to the point on the tubular structure contacted by the corner of the ring inner surface, if the corner has a keen edge of a substantially right angle. In contrast, if the corner is rounded, the stress applied to the above-mentioned point will be zero, however, the radius of curvature of the roundness may be small. As a matter of fact, however, the radius R of curvature should be large to some extent, in order to effectively avoid the damaging of the outer peripheral surface of the tubular structure. The inventors have conducted an experiment to obtain a result as shown in Table 1 below, from which it will be understood that the radius R of curvature should be at least 5 mm, in order to obtain a satisfactory effect in preventing the damaging of the surface of tubular structure.

TABLE 1

| radius of (R) curvature (mm) | 0 | 2.5 | 5 | 7.5 |
|---|---|---|---|---|
| state of damage | heavy | slight | none | none |

Figure 9:
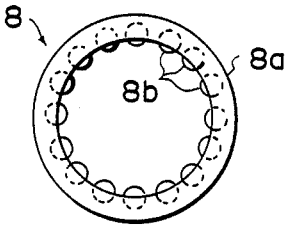

The ring 8 shown in FIG. 6 is the simplest one composed merely of an annular body. This, however, is not exclusive and the ring 8 shown in FIG. 6 may be substituted by a ring assembly in which, as shown, in FIG. 9, a multiplicity of small rollers 8*b* are rotatably carried by the inner peripheral surface of an annular member 8*a* so that the rollers 8*b* make rolling contact with the outer peripheral surface of the tubular structure.

Figure 10:
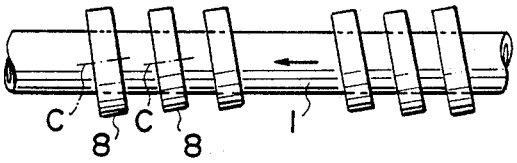
FIG. 10 is a schematic illustration of the device shown in FIG. 6.
Figure 11:
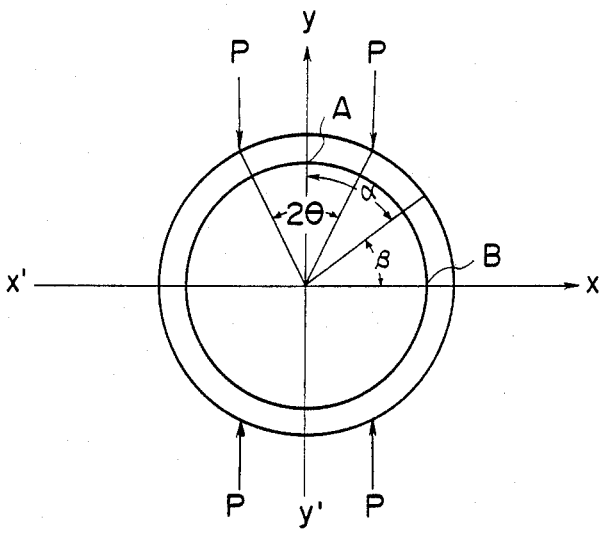
FIG. 11 is a schematic illustration of a device for compressing a tubular structure by application of symmetrical loads at two points on the upper side and at two points on the lower sides of the tubular structure.

It is to be understood also that the use of separate known mechanism such as pusher for feeding the tubular structure is not essential. For instance, instead of using such a separate feeding mechanism, the rings 8 are arranged in such a manner that their axes are inclined in both directions with respect to the direction of movement of the tubular structure as shown by plan in FIG. 10, so that these rings 8 may exert an axial thrusting force on the tubular structure to feed the latter in the axial direction as in the case of the known contracted rollers shown in FIG. 2A. In this case, however, it is necesary to taper the inner peripheral surface of the ring in conformity with the outer peripheral surface of the tubular structure.

(ii) Application of load at two upper points and two lower points

The stress distribution was examined while compressing the tubular structure 1 by applying parallel loads simultaneously on four points on the circumference of cross-section thereof. Two upper points of application of load and two lower points of application of load are arranged in symmetry with respect to the vertical line passing through the central axis of the tubular structure, at an equal angle $\theta$ from the vertical line.

The moment $M_1$ in the angular region of $\alpha$ which ranges between 0 and $\theta$ from the vertical line y—y' is given by the following formula (4).

$$\frac{M_1}{PD} = \frac{1}{\pi}\{(\pi - 2\theta)\sin\theta - 2\cos\theta\} = \text{constant} < 0 \quad (4)$$

Similarly, the moment $M_2$ in the angular region $\alpha$ of between $\theta$ and $\pi/2$ is given by the following formula (5).

$$\frac{M_2}{PD} = \frac{1}{\pi}\{(\pi - 2\theta)\sin\theta - 2\cos\theta\} + \sin\alpha - \sin\theta \quad (5)$$

Figure 12:
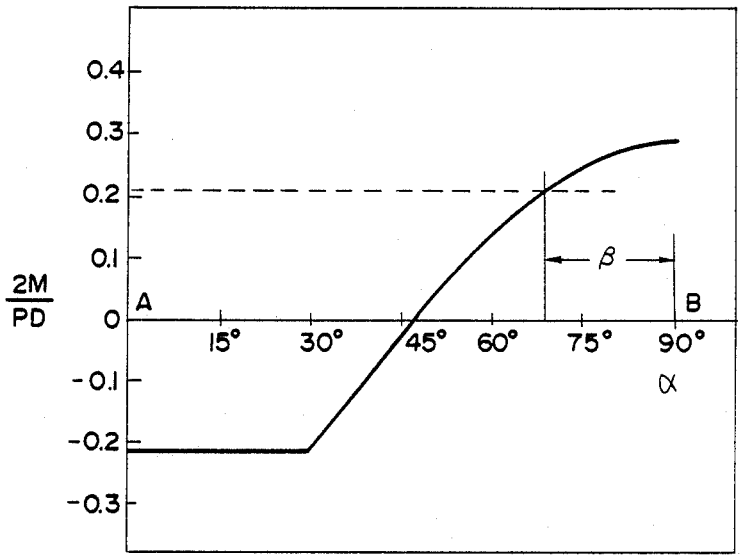
FIG. 12 is a moment diagram as drawn on the tubular structure under the condition of $\theta=\pi/6$.

A moment distribution as obtained when the angle $\theta$ is $\pi/6$ is shown in FIG. 12. In this case, the moment appearing at the point A is negative to develop a tensile stress in the inner surface of the tubular structure, while the moment at the point B is positive to cause a compressive stress in the inner surface of the tubular structure.

If the compression stress appeared around the point B has an absolute value greater than that of the tensile stress appearing around the point A, i.e. if the following condition (6) is met, it is possible to develop a tensile residual stress in the inner peripheral surface of the tubular structure by rotating the same to repeatedly apply the compression so as to subject the whole part of the tubular structure to a compression yielding.

$$M_2-(-M_1)>0 \quad (6)$$

The stress distribution shown in FIG. 12 satisfies this condition. It will be seen that compression stress of absolute value greater than that of the stress at the point A is obtainable within the angular range $\beta$.

The angular range $\beta$ can be determined by substituting the formulae (4) and (5) for the formula (6), as follows.

The following condition is derived by the substitution.

$$\frac{2}{\pi}\{(\pi - 2\theta)\sin\theta - 2\cos\theta\} + \sin\alpha - \sin\theta > 0$$

This formula is transformed into the following formula (7).

$$\sin\alpha > \left(\frac{4\theta}{\pi} - 1\right)\sin\theta + \frac{4}{\pi}\cos\theta \quad (7)$$

On the other hand, there is a relationship as expressed by the following formula (8).

$$\beta = \frac{\pi}{2} - 2 \quad (8)$$

Figure 13:
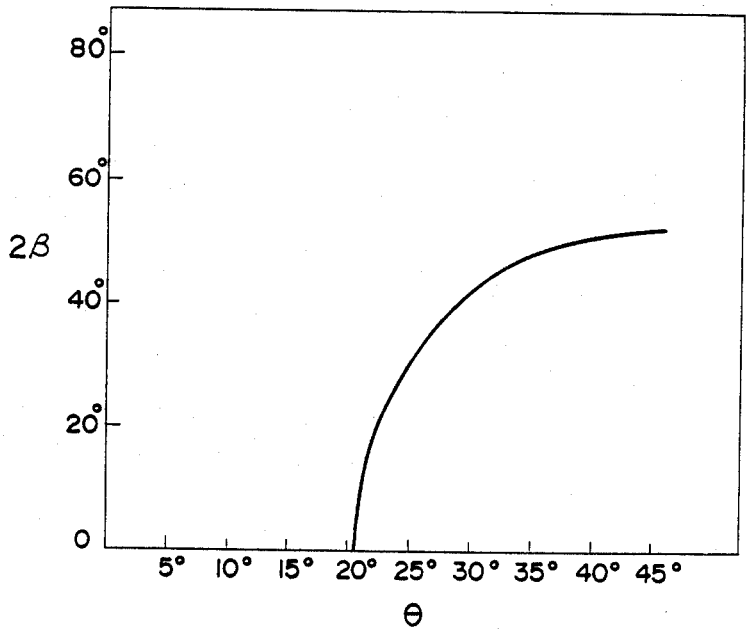
FIG. 13 shows the relationship between the angle $\theta$ shown in FIG. 11 and the angle $\beta$ of the region subjected to compression stress.

From the formulae (7) and (8), the range of the angle $\beta$ is determined as shown in FIG. 13. The angular range $\beta$ can take a value greater than 0 (zero) when the angle $\theta$ takes a value greater than 20°. On the other hand, the angle value of $\theta$ exceeding 45° makes it difficult to apply parallel loads to the tubular structure 1. From this point of view, the angle $\theta$ is preferably selected within a range between 20° and 45°.

With this knowledge, the inventors propose a method having the steps of: preparing an upper U-shaped block 11 and a lower U-shaped block 11' arranged in a pair, each U-shaped block being adapted to contact the tubular structure 1 at points located at an angle of $2\theta$ ($20° < \theta < 45°$) from the central axis and having a length greater than that of the tubular structure 1, compressing the tubular structure 1 in the vertical direction by the upper and lower blocks, and repeating the application of compression while changing the loading points through rotating the tubular structure 1. The blocks 11,11' may have a length smaller than that of the tubular structure. In such a case, however, it is necessary to shift the tubular structure in the axial direction to repeat the steps of application of compression load.

Figure 14:
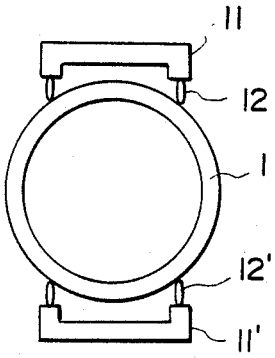
FIG. 14 is a sectional view of a U-shaped block for use in applying symmetrical loads, at two points on the upper side and at two points on the lower side of the tubular structure, in accordance with an embodiment of the invention.

As an alternative, it is possible to feed the tubular structure 1 by a suitable driving means through a plurality of pairs of blocks, each having a cross-section as shown in FIG. 14, arranged at offset in the axial direction in such a manner that the direction of application of compression loads is varied regularly. In this case, the blocks 11,11' may be provided with rollers 12,12' for making rolling contact with the tubular structure 1.

The rollers 12, 12' need not be parallel to the axis of the tubular structure 1 fed through the blocks 11, 11'. It is possible to develop the residual tensile stress in the peripheral inner surface of the tubular structure by feeding the same through only one pair of blocks 11, 11' while rotating the tubular structure around its axis. In such case, the blocks 11 and 11' should contain rollers 12, 12' disposed at an angle to the feeding direction of the tubular structure 1.

Preferred embodiments of the invention will be described hereinunder.

EXAMPLE 1

Figure 15:
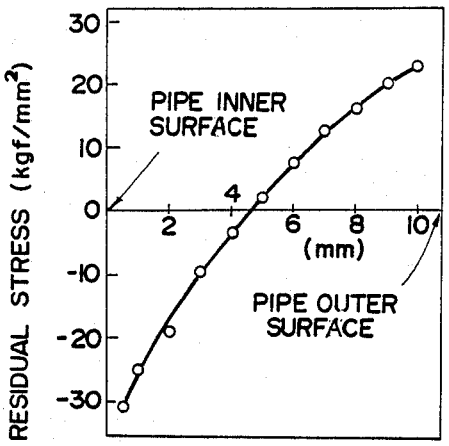
FIG. 15 shows the distribution of residual stress in the thicknesswise direction of the steel pipe used in Embodiment 1.

A steel pipe (0.23%C-0.23%Si-1.48%Mn-0.10% Mo series) having an outside diameter of 5½" and wall thickness of 8.7 mm was used as the test pipe. This steel pipe exhibited thickness-wise distribution of circumferential residual stress as shown in FIG. 15, and showed a compressive residual stress of about 30 Kgf/mm$^2$ in the inner peripheral surface thereof. The yield stress $\sigma_Y$ was 77 Kgf/mm$^2$.

Figure 16:
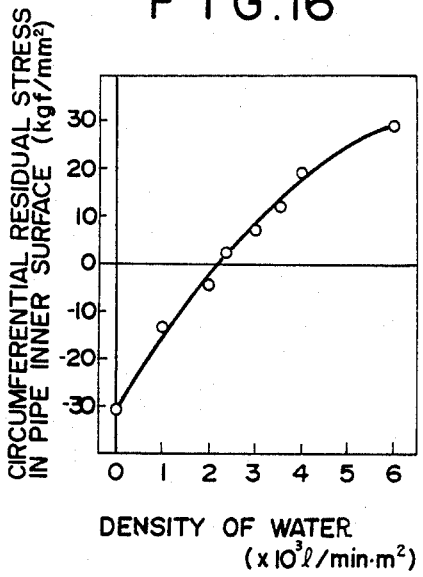
FIG. 16 shows the relationship between the density of the cooling water and the level of the circumferential residual stress in the inner peripheral surface of the steel pipe.
Figure 17:
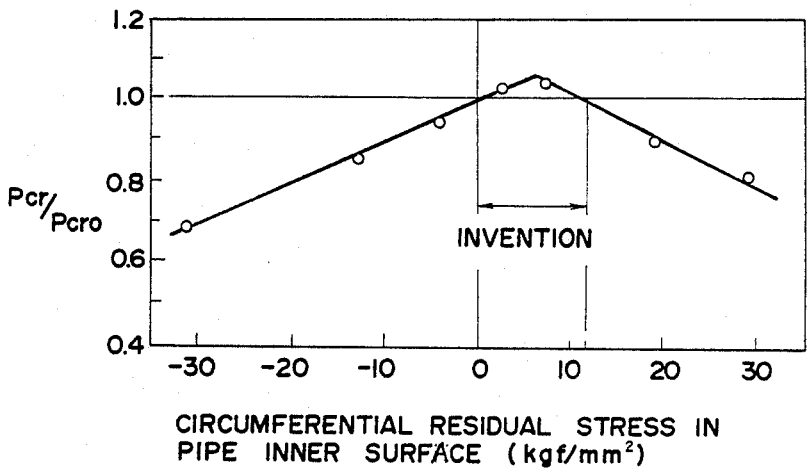
FIG. 17 shows the relatinship between the residual stress and the collapse strength.

This steel pipe was reheated to a temperature higher than 500° C. and was cooled from the outer side thereof by water at various cooling rates to impart various levels of residual stress in the inner surface of the pipe. FIG. 16 shows the relationship between the density of cooling water and the residual stress in the inner peripheral surface of the pipe as obtained through the test. Through this test, it was confirmed that the residual stress value in the inner peripheral surface of the pipe is controllable as desired within the region of between 30 Kgf/mm$^2$ (tensile) and −30 Kgf/mm$^2$ (tensile), by varying the cooling condition after the heating. The test pieces of pipes thus treated were subjected to a collapse test to exhibit a result as shown in FIG. 17. Since the yield stress in the circumferential direction is slightly changed, the ordinate is plotted in terms of the aforementioned value Pcr/Pcro. As will be clearly understood from FIG. 17, when the residual stress imparted to the inner peripheral surface is a tensile stress which is not greater than 15% of $\sigma_Y$ as specified by the invention, a higher collapse strength is ensured than with the conventional products in which the residual stress is zero.

EXAMPLE 2

Steel pipes having chemical compositions and mechanical properties shown in Table 2 were used in the test. The test pipe A was an as-rolled pipe, while the test pipe B was a quench-tempered pipe. The outside diameter and wall thickness of both pipes were 114 mm and 6.88 mm, respectively.

TABLE 2

| | C | Si | Mn | P | S | Y.P (Y) | T.S |
|---|---|---|---|---|---|---|---|
| A | 0.25% | 0.24% | 1.32% | 0.022% | 0.021% | 68.0 Kg/mm$^2$ | 79.8 Kg/mm$^2$ |
| B | 0.24% | 0.36% | 1.49% | 0.026% | 0.011% | 89.2 Kg/mm$^2$ | 94.9 Kg/ |

TABLE 2-continued

| C | Si | Mn | P | S | Y.P (Y) | T.S |
|---|---|---|---|---|---|---|
| | | | | | | mm$^2$ |

With these test materials, cooling treatment was conducted by a cooling line as shown in FIG. 3 while varying the cooling condition.

Figure 18:
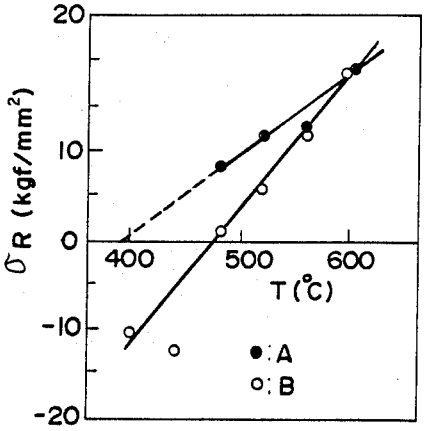
Figure 19:
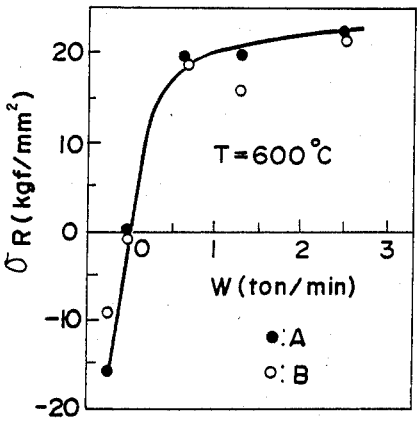

FIG. 18 shows the value of the circumferential residual stress $\sigma_R$ in the inner peripheral surface of the tubular structure after the cooling treatment conducted under a condition of cooling water supply rate W of 0.65 Ton/min and pipe feeding velocity V of 550 mm/min, while varying the temperature T at which the cooling is commenced. Also, FIG. 19 shows the circumferential residual stress $\sigma_R$ in the inner peripheral surface of the steel pipe after the cooling as obtained under cooling conditions of the above-mentioned temperature T of 600° C. and velocity V of 550 mm/min while varying the rate of supply of the cooling water. From these Figures, it will be seen that the residual stress $\sigma_R$ is variable depending on the factors such as the temperature T, rate W of water supply and the yield stress $\sigma_Y$. The relationship between the residual stress $\sigma_R$ and these factors, as illustrated in FIGS. 18 and 19, satisfies the foregoing formula (1).

Figure 20:
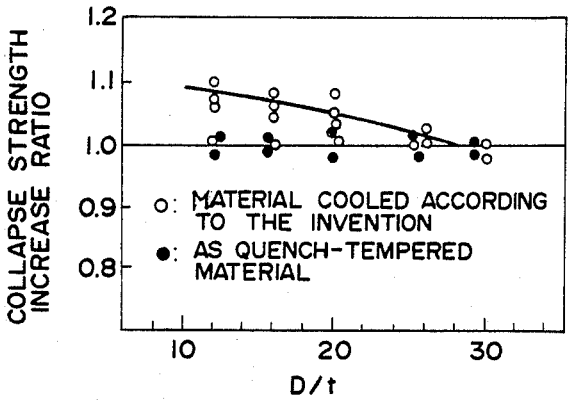

In order to confirm the effect of the cooling treatment in accordance with the invention, a test was conducted on various sizes of steel pipes (quench-tempered) using the same cooling line, in which the rate W of supply of cooling water was controlled in accordance with the formula (2) mentioned before in response to the change in temperature T at which the cooling was commenced. FIG. 20 shows the degree of improvement in the collapse strength, obtained through dividing the collapse strength of the steel pipe which has undergone the cooling treatment by the mean collapse strength of the reference steel pipes which are quench-tempered pipes of the same size and composition as the test pipes. From this Figure, it will be seen that the collapse strength of the steel pipe is improved remarkably by the cooling treatment in accordance with the invention. Indeed, the improvement ratio reaches about 8% when the diameter to thickness ratio D/t of the steel pipe is 12.

EXAMPLE 3

Straightenings were conducted in accordance with the method of the invention and by the conventional method, using as the test materials steel pipes having a chemical composition as shown in Table 3. The outside diameter, wall thickness and the yield strength of the test material were 244.5 mm, 15.11 mm and 79.2 kgf/mm$^2$, respectively.

TABLE 3

| (wt %) | | | | | |
|---|---|---|---|---|---|
| C | Si | Mn | P | S | Cr |
| 0.23 | 0.30 | 1.21 | 0.021 | 0.024 | 0.27 |

Figure 21:
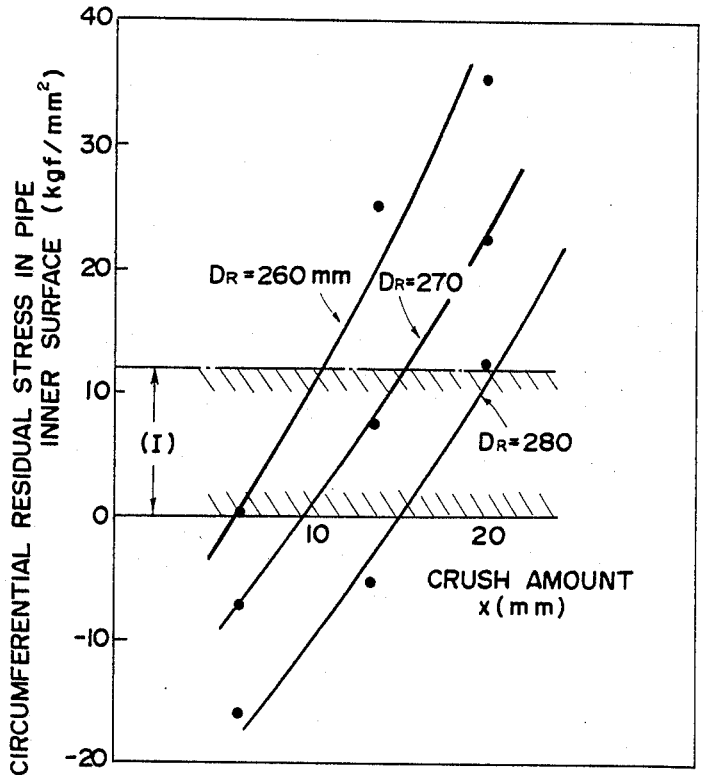

Straightening operations were conducted in accordance with the invention employing the device shown in FIG. 6 using three kinds of rings 8 of different inside diameters $D_R$ of 260 mm, 270 mm and 280 mm, while varying the crush amount X. The circumferential residual stress in the inner peripheral surface of the pipe was measured for each of the thus treated tubes, the result of which is shown in FIG. 21. From this Figure, it will be seen that the method of the invention employing the rings can make the circumferential residual stress after the treatment fall within the preferred range (I) for obtaining sufficient collapse strength, by suitably selecting the crush amount X in relation to the inside diameter $D_R$ of the rings.

Figure 22:
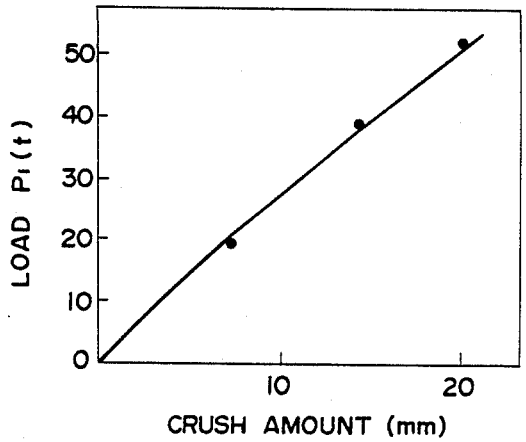

FIG. 22 illustrates the relationship between the crush amount and the level of the load applied to the tubular structure during the treatment in accordance with the invention. From this Figure, it will be clearly understood that the load is increased substantially in proportion to the increase in the crush amount.

Figure 23:
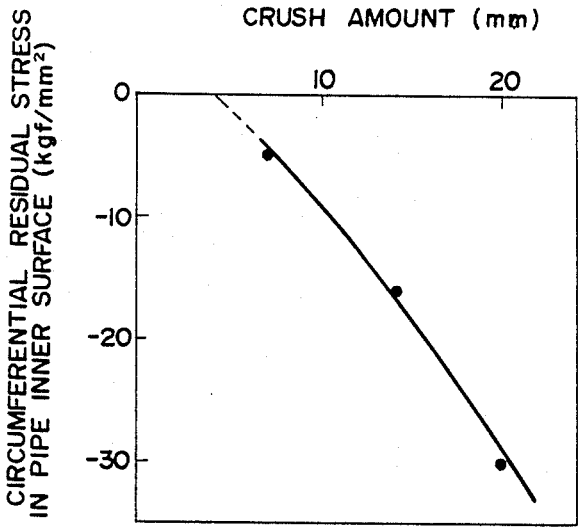

Subsequently, straightening operations were conducted by the conventional straightening method with the apparatus shown in FIG. 2A employing rolls contracted at the center, while varying the crush amount. The circumferential residual stress in the inner peripheral surface of the tubular structure after the treatment was measured for each tubular structure, the result of which is shown in FIG. 23.

As will be seen from this Figure, this conventional method always imparts compressive residual stress the level of which is increased as the crush amount is increased. In general, a crush amount of at least 15 mm is necessary for attaining sufficient straightening effect. FIG. 23 shows that the crush amount of 15 mm induces a compressive residual stress of about $-18$ Kgf/mm$^2$ which is calculated to be $-0.23\ \sigma_Y$ in relation to the yield stress $\sigma_Y$. This compressive residual stress causes about 20% reduction in the collapse strength as compared with that in the state before the treatment, as will be understood from the relationship shown in FIG. 1.

In contrast to the above, according to the invention, it is possible to attain about 1.08 times increase of the collapse strength as compared with that in the state before the treatment, when the ring inside diameter ranges between 270 and 280 mm. This means that the method of the invention provides about 30% increase of the collapse strength after the straightening, as compared with the conventional method. It is to be pointed out also that the device shown in FIG. 6 could provide a straightness substantially equivalent to that provided by the conventional method.

EXAMPLE 4

Steel pipes used as the test pipes were made from a material of a chemical composition shown in Table 4, and had an outside diameter, wall thickness and length of 177.8 mm, 18.54 mm and 500 mm, respectively. The yield strength was 72.6 Kg/mm$^2$. The test pipes were compressed by means of a pair of the U-shaped blocks having a cross-section as shown in FIG. 14. The length of the block was 600 mm, while the span of the contact points was 180 mm. The application of compression load was made repeatedly while rotating the steel pipe to impart a circumferential residual tensile stress in the inner peripheral surface of the steel pipe.

TABLE 4

| Chemical Composition | | | | | |
|---|---|---|---|---|---|
| C | Si | Mn | P | S | Cr |
| 0.23 | 0.28 | 1.28 | 0.014 | 0.012 | 0.31 |

Figure 24:
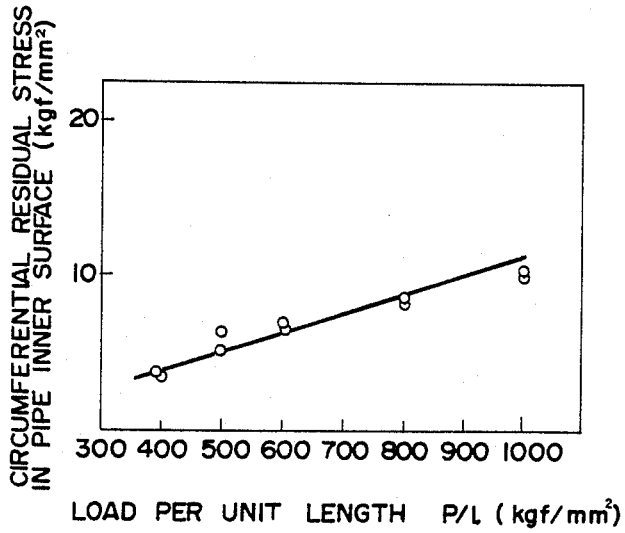
FIG. 24 is a graph showing the relationship between the load per unit length p/l and the circumferential residual stress in the inner peripheral surface of the pipe as obtained in Embodiment 4 of the invention.

FIG. 24 shows the relationship between the load value P/l (Kg/mm) applied and the level of the residual tensile stress developed as a result of application of the load.

As will be seen from this Figure, in the present example of the invention, the residual stress is always imparted in a tensile direction and the level of this residual tensile stress is increased in accordance with the increase in the load applied. It is, therefore, easy to control the level of the residual tensile stress to make the same fall within desired level.

Although the invention has been described with reference to specific examples, it is to be understood that the described embodiments and examples are not exclusive but merely illustrative, and various changes and modifications may be possible without departing from the scope of the invention which is limited solely by the appended claims.

What is claimed is:

1. A method of producing a metallic tubular structure having improved collapse strength, comprising applying two pairs of compression loads to two pairs of points on the outer surface of the tubular structure from opposite sides thereof, the two points of each pair of points being spaced apart from one another by an angle of 40–90 degrees measured from the longitudinal axis of the tubular structure, the magnitude of the loads being such that a circumferential residual tensile stress greater than zero and at most 15% of the yield stress of the material consistituting the tubular structure is developed in the inner peripheral surface of the tubular structure, said loads being repeatedly applied to different portions of the circumference of said tubular structure.

2. A method as claimed in claim 1, wherein each pair of compression loads is applied by a U-shaped block which contacts the periphery of the tubular structure at two points on the circumference thereof.

3. A method as claimed in claim 2, wherein each of said U-shaped blocks has a length which is greater than the axial length of the tubular structure, further comprising rotating the tubular structure about its longitudinal axis while said compression loads are applied.

4. A method as claimed in claim 2, wherein there is a plurality of pairs of said U-shaped blocks, each of said U-shaped blocks having a length which is less than the axial length of the tubular structure, said pairs of U-shaped blocks being staggered about the circumference of the tubular structure, further comprising the step of moving the tubular structure in the axial direction thereof while compression loads are continuously applied thereto by said U-shaped blocks.

5. A method of producing a metallic tubular structure having improved collapse strength, comprising:

disposing at least one ring having a diameter larger than the diameter of the tubular structure around the tubular structure; and applying a force to said ring so that a distributed load is applied to the tubular structure at different portions on the periphery thereof, the distributed load being of a magnitude such that a residual tensile stress in the circumferential direction having a magnitude greater than zero and at most 15% of the yield stress of the material constituting the tubular structure is generated in the inner peripheral surface thereof.

6. A method as claimed in claim 5, wherein a plurality of said rings simultaneously apply distributed loads to the tubular structure.

7. A method as claimed in claim 6, wherein there are a plurality of groups of said rings, each group comprising three adjacent rings, the force which is applied to each ring being such that the distributed load which is exerted by the ring is in the opposite direction from the distributed load exerted by the adjacent ring in the same group.

8. A method as claimed in claim 6, further comprising rotating said rings while advancing the tubular structure in the axial direction thereof.

9. A method as claimed in claim 8, wherein said rings are nonperpendicular to the longitudinal axis of the tubular structure, whereby the rotation of said rings causes the tubular structure to advance in the axial direction.

10. A method as claimed in claim 8, further comprising rotating the tubular structure about its longitudinal axis as it is advanced.

11. A method as claimed in claim 5, wherein the distributed load $P_1$ which is applied by each ring satisfies the following equation:

$$P_1 \geqq \frac{2Et^3}{3D} \cdot \frac{\left(\frac{1}{D} - \frac{1}{D_R}\right)}{\left(1 - \frac{2}{\pi}\right)}$$

* * * * *